166-250
FTP8011 XR 3,965,978

United States Patent [19]
Conley et al.

[11] 3,965,978
[45] June 29, 1976

[54] SUBSURFACE TRANSIENT PRESSURE TESTING APPARATUS AND METHOD OF USE THEREOF

[75] Inventors: Dell Conley; Howard H. Ferrell; Jaime A. Lescarboura, all of Ponca City, Okla.

[73] Assignee: Continental Oil Company, Ponca City, Okla.

[22] Filed: Nov. 6, 1974

[21] Appl. No.: 521,323

Related U.S. Application Data

[63] Continuation-in-part of Ser. No. 485,688, July 2, 1974, abandoned.

[52] U.S. Cl. ..... 166/113; 166/151; 166/153; 166/188; 166/250

[51] Int. Cl.[2] ..... E21B 47/022; E21B 47/10; E21B 33/12

[58] Field of Search ..... 166/113, 153, 188, 193, 166/194, 151

[56] References Cited

UNITED STATES PATENTS

| | | | |
|---|---|---|---|
| 1,946,576 | 2/1934 | Dunn et al. | 73/151 |
| 1,955,855 | 4/1934 | Marx | 73/151 |
| 2,223,913 | 12/1940 | Johnston | 73/151 |
| 2,776,015 | 1/1957 | Bielstein | 166/188 |
| 2,999,545 | 9/1961 | Bigelow | 166/153 |
| 3,070,167 | 12/1962 | Loy et al. | 166/153 |

*Primary Examiner*—Stephen J. Novosad
*Assistant Examiner*—George A. Suckfield
*Attorney, Agent, or Firm*—Richard W. Collins

[57] ABSTRACT

Wireline apparatus and method for measuring pressure downhole in well tubing comprising a main plug body which seats in a seating nipple forming part of the tubing, a pressure gauge in communication with the tubing below the main plug body, and means for equalizing the tubing pressure above and below the seated main plug body so that the apparatus may be removed from the well.

11 Claims, 2 Drawing Figures

SUBSURFACE TRANSIENT PRESSURE TESTING APPARATUS AND METHOD OF USE THEREOF

CROSS-REFERENCES TO RELATED APPLICATIONS

This application is a continuation-in-part of parent application Ser. No. 485,688, filed July 2, 1974, now abandoned, entitled: "Subsurface Transient Pressure Testing Apparatus."

BACKGROUND OF THE INVENTION

1. Field of the Invention

The invention relates to a method and apparatus useful in determining subsurface pressure in a well. More particularly, the invention relates to such a method and apparatus useful in conjunction with making transient pressure determinations.

2. Description of the Prior Art

Subterranean pressure data from wells is useful for a wide variety of purposes including: determining the efficiency of the well completion; establishing the need for and success of a well stimulation treatment; determining the general type of well treatment desirable; establishing whether or not a well is connected to other wells; and the like. One type of pressure which can provide valuable information about a reservoir is the transient pressure response of a well, i.e., the pressure response which results from a change in a well's production rate or injection rate. A transient pressure in a well can be created by putting a closed-in well on production or injection or by changing the flow rate of a well which has been producing or into which fluid has been injected at a constant flow rate for some period of time and has reached a pseudo steady-state behavior. Types of transient pressure behavior include: pressure drawdown and buildup in producing wells; skin damage tests; pressure falloff in injection wells; multiple-rate tests in both producing wells and injection wells; and interference or pulse tests between two or more wells in a reservoir.

Several types of transient pressure tests depend on determining the tubing pressure at a subterranean location immediately after a tubing valve at the surface of a well have been closed. Such tests are difficult to run and control because fluid has been flowing in the tubing immediately prior to the shut-in. A change in the flow rate of the well by closing a valve at the surface can result in an inaccurate indication of the subsurface pressure as measured by a subsurface pressure gauge. Because of the large volumes of the well tubing and the tubing-casing annulus, closing only a surface valve does not instantaneously stop flow into or out of the wellbore at the bottom of the well. Interpretation of these transient pressure tests is based on the assumption that no flow occurs after the surface tubing valve is closed.

Various techniques of mathematical manipulation have been proposed to minimize the error from the continued flow of fluid, usually called "afterflow," occurring after a surface valve is closed. However, these techniques are subject to interpretation and errors. Various mechanical methods have previously been proposed for closing off the bottom of the well tubing to fluid flow at the same time that a surface valve is closed. Such device heretofore have been expensive and complicated. Some of these methods involve running a pack-off apparatus as soon as the surface valve is closed. Obviously there is a considerable time delay required to run the apparatus to the desired downhole location and set it. An electric packer run on a conductor cable has been used but requires several minutes to set resulting in loss of valuable data, as the delay in shutoff results in continued flow through the tubing. A tubing packer gauge hanger device requiring wireline jars to set is has been unsatisfactory because gauge damage often results from the jarring action.

It is an object of this invention to provide a method and apparatus for running transient pressure tests.

It is a further object to provide such a method and apparatus which shuts off fluid flow into or out of the bottom of the well tubing almost instantaneously following closing of a tubing valve at the surface.

It is a still further object to provide such an apparatus which may be quickly opened and retrived following completion of the subsurface pressure determination to allow flow through the tubing to resume.

It is another object to provide such an apparatus, the opening and closing of which may be controlled from the surface of the well.

It is still another object to provide a method and apparatus which will maintain shut-in at the bottom of well tubing of an observation well during an interference test.

Other objects, advantages, and features of the invention will be apparent from the following discussion, drawings, and appended claims.

BRIEF SUMMARY OF THE INVENTION

A wireline or cable retrievable pressure-measuring apparatus suitable for shutting off fluid flow through tubing at a subsurface location in a well containing a packer in the tubing-casing annulus comprising:

a. a seating nipple forming part of the tubing string positioned at the downhole location at which it is desired to shut off fluid flow through the tubing, said seating nipple having an upwardly-facing shoulder area having a smaller diameter than the inside diameter of the tubing, b. a first or main plug body having a downwardly-facing first seating area around the exterior thereof adapted to seat in the seating nipple and form a fluid-impermeable seal therewith, said main plug body having a passageway therethrough comprising a first port extending from a point below the point of seal of the main plug body with the seating nipple to a second seating area and a second port from the second seating area to a point above the point of seal of the main plug body with the seating nipple, c. a pressure measuring means communicating with the tubing space below the point of seal of the main plug body with the seating nipple, d. a second or relief plug body adapted to seat in the second seating area of the main plug body, e. spring means to urge the relief plug body toward the second seating area of the main plug body, and f. a wireline or cable connecting the main plug body to the surface of the well.

The above-described apparatus is used as follows:

a. running into the borehole to a downhole location as part of the tubing string the seating nipple and the annular packer, b. seating the annular packer, c. running into the tubing string via a wireline a composite comprising the first plug body, pressure measuring means, second plug body, and spring means, d. positioning said composite just above the seating nipple, e. flowing fluid through the borehole, f. shutting off fluid flow through the borehole at the surface of the well, g. lowering the composite via the wireline into contact with the seating nipple, h. recording the pressure in the tubing string below the seating nipple, i. equalizing the pressure in the tubing string above and below the composite by pulling upwardly on the wireline to pull the second plug body away from the second seating area, and j. removing the composite from contact with the seating nipple by further pulling upwardly on the wireline.

DESCRIPTION OF THE PREFERRED EMBODIMENT

Figure 1:
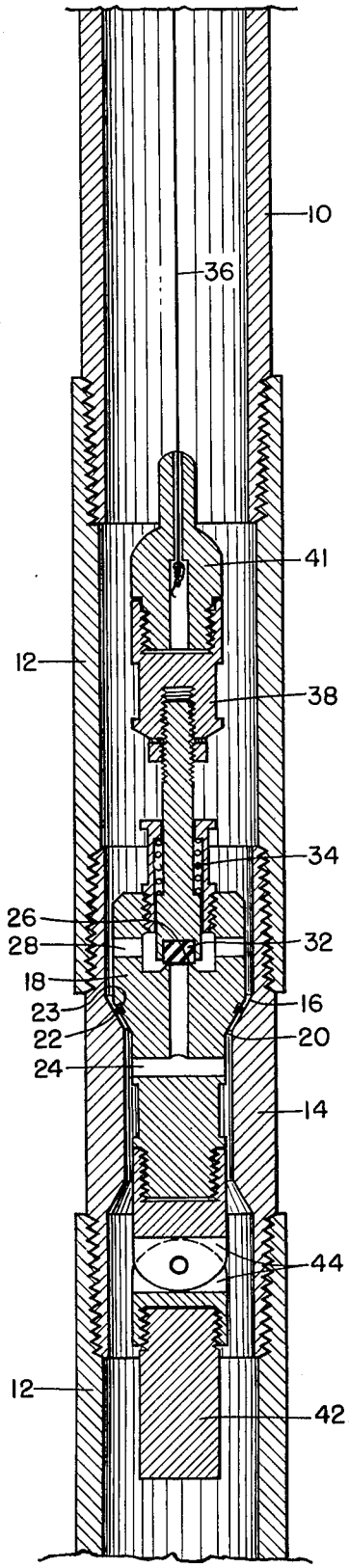
FIG. 1 is a longitudinal section of one embodiment of the subsurface transient pressure testing apparatus in closed position which does not allow fluid to flow through the tubing.

Referring now to FIG. 1, sections of tubing string 10 connected by sections of tubing collar 12 extend from the surface of a well to a subsurface location where it is desired to measure transient pressure. Seating nipple 14 is positioned between and threaded into two tubing collars 12. Seating nipple 14 has relatively large upwardly-facing shoulder area 16 which has an inside diameter less than that of tubing string 10. First or main plug body 18 has relatively large downwardly-facing shoulder area 20 which mates against upwardly-facing shoulder area 16 of seating nipple 14 to form a fluid-impermeable seal. A suitable sealing means 22, which may be of rubber, a soft metal, or similar material such as an O-ring, is optionally positioned in groove 23 cut in downwardly-facing shoulder area 20 of main plug body 18. Resilient sealing means 22 provides an improved seal between upwardly-facing shoulder 16 and downwardly-facing shoulder 20. Alternatively sealing means 22 can be positioned in a groove (not shown) cut in upwardly-facing shoulder 16. Main plug body 18 contains a passageway or aperture therethrough comprising first port 24 extending from a point below the seal between upwardly-facing shoulder 16 and downwardly-facing shoulder 20 to upwardly-facing relatively small shoulder area 26 and second port 28 extending from upwardly-facing shoulder area 26 to a point above the seal between upwardly-facing shoulder 16 and downwardly-facing shoulder 20. Main plug body 18 also contains a second or relief plug member 30, bottom end 32 of which is adapted to seat against shoulder area 26 and close the passageway through main plug body 18 comprising first port 24 and second port 28. Bottom end 32 of relief plug member 30 which seats against shoulder area 26 can be the same material, a metal, of which relief plug member 30 is made. Preferably, bottom end 32 is an insert made of a resilient material to improve the seal. As shown in FIG. 1, relief plug member 30 is held against shoulder area 26 against which it is urged by spring 34. Relief plug 30 is attached at its upper end to wireline 36 by suitable connecting means such as threaded adapter 38 and wireline socket 41. Subsurface pressure recording gauge 42 is attached to the lower end of main plug body 18 as by coupling means 44 such as a flexible coupler.

Figure 2:
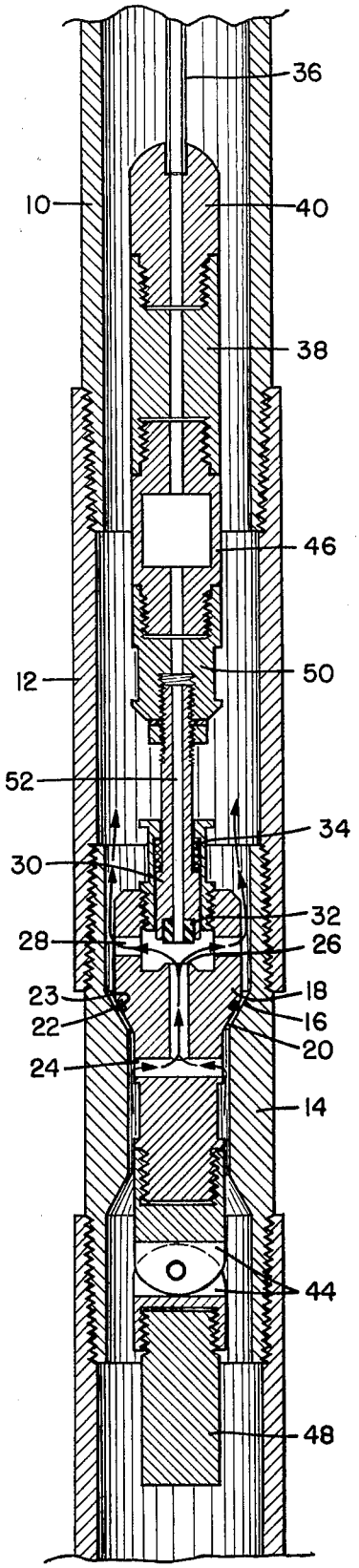
FIG. 2 is a longitudinal section of another embodiment of the subsurface transient pressure testing apparatus in open position which allows fluid to flow through the tubing.

The apparatus illustrated in FIG. 1 can be employed in making a determination of subterranean pressure during a transient pressure test as follows: Seating nipple 14 is made part of a tubing string which is made up and run into a well. Generally seating nipple 14 is positioned at or near the bottom of a tubing string. A packer (not shown) is run down the tubing-casing annulus and positioned so as to close off the tubing-casing annulus at or near the bottom of the tubing. The remainder of the apparatus is run down the tubing via wireline 36 until main plug body 18 is in the vicinity of, but not yet in contact with, seating nipple 14. The weight of main plug body 18 and associated apparatus is sufficiently great to collapse spring 34, thus holding relief plug member 30 away from shoulder area 26 as long as the apparatus is suspended in tubing 10 above seating nipple 14. With the apparatus in this position, fluid can flow through tubing 10 and around and through main plug body 18. When it is desired to determine the transient pressure, a tubing valve (not shown) at the surface of the well is closed to stop fluid from flowing into or out of the tubing at the surface. Simultaneously, wireline 36 is further lowered until upwardly-facing shoulder 16, downwardly-facing shoulder 20, and sealing means 22 come into contact. Tension on wireline 36 is then relaxed and spring 34 urges pressure relief plug 30 to seat against upwardly-facing shoulder 26, as shown in FIG. 1. Thus, flow is stopped through the tubing at the downhole location. Subsurface recording gauge 42 is of a conventional type having a clock mechanism allowing continuous recording of pressure with time. When sufficient pressure recordings have been made, wireline 36 is pulled upwardly until relief plug 30 is pulled away from its seal with relatively small shoulder area 26 (as shown in FIG. 2) allowing fluid to flow through first port 24 and second port 28 to equalize the pressure above and below main plug body 18. When the pressure has substantially equalized, an additional upward pull on wireline 36 allows main plug body 18 and the remainder of the apparatus to be pulled free from its seal with upwardly-facing shoulder 16 of seating nipple 14. The apparatus can then be pulled from tubing 10 by wireline 36 and the pressure data recorded by subsurface recording gauge 42, examined, and utilized in various transient pressure calculations.

It has been the experience that in certain instances where prior downhole tubing plugs were set in a seating nipple, a considerable pressure differential quickly built up with the pressure above the tubing plug being considerably greater than that below the tubing plug. This pressure differential makes it extremely difficult if not impossible to directly pull the tubing plug away from the relatively large seating area with the seating nipple. By the use of the apparatus of this invention, employing relief plug 30 which seats on relatively small shoulder area 26, it has been possible to pull relief plug 30 away from shoulder area 26 with much less of a pull on wireline 36. Once the pressure above and below the tubing plug substantially equalizes due to fluid flow through ports 24 and 28, the entire apparatus may be easily pulled off seating nipple 14. In one embodiment of the apparatus adapted to be run in a 2-inch inside diameter tubing, bottom end 32 was 15/32-inch in diameter and the ratio between the area of seal between shoulder areas 16 and 20 to the area of seal between bottom end 32 and shoulder area 26 was 64 to 1.

Referring now to FIG. 2, an embodiment of the apparatus is shown which is substantially like the embodiment shown in FIG. 1 except that pressure is recorded at the surface rather than by subsurface recording gauge 42. In addition, weighted sinker bar 48 is positioned below main plug body 18 to insure that the apparatus attached to cable 36 drops into correct alignment with seating nipple 14. More particularly, the positioning of seating nipple and the relative positions of main plug body 18, downwardly facing shoulder 20, sealing means 22, groove 23, first port 24, shoulder area 26, second port 28, relief plug member 30, bottom end 32 of relief plug member 30, and spring 34 are the same as in FIG. 1 and a detailed explanation thereof will not be given again. As shown in FIG. 2, bottom end 32 of relief plug 30 is held away from shoulder area 26, against which it is urged by spring 34, by applying an upward pull on cable 36. This positioning of the elements allows fluid to flow through main plug body 18. This illustrates the equalization of pressure that may be carried out with the embodiments of either FIG. 1 or FIG. 2 when it is desired to unseat the apparatus and remove it from the well.

Further in FIG. 2, hollow housing 46 is attached to the upper end of relief plug 30 as by hollow threaded adapter 50. To enable hollow housing 46 to communicate with the tubing volume below main plug body 18, third port 52 is provided through relief plug 30 which extends from bottom end 32 thereof to hollow housing 46. Cable 36 performs a double duty as the means of lowering and raising the apparatus through the tubing as well as the means of transmitting indication of the pressure from hollow housing 46 to the pressure-indicating apparatus (not shown) at the surface of the well. In one embodiment hollow housing 46 merely serves as a conduit and cable 36 is a flexible hollow conduit. Thus the pressure inside cable 36 at the surface of the well is the same as that in the tubing below main plug body 18. Cable 36 can be connected to pressure-indicating means at the surface in a known manner to indicate at the surface the pressure in the tubing below main plug body 18. Alternatively hollow housing 46 contains a pressure recording gauge (not shown) which emits electrical signals, and cable 36 is a shielded electrical conducting cable which connects with known apparatus at the surface (not shown) which converts electrical signals to pressure and thus indicates the pressure in the tubing below main plug body 18.

The embodiment shown in FIG. 2 is used in the same manner as the embodiment shown in FIG. 1 except that the pressure in the tubing below the main plug body 18 is indicated at the surface of the well rather than in subsurface recording gauge 42 which must be recovered and observed following the running of a test. It is possible, if desired, to use both subsurface recording gauge 42 and a surface recording gauge in a single apparatus. It is also possible in a further embodiment of the apparatus that hollow housing 46 can contain subsurface recording gauge 42 and cable 36 can be a wireline.

The seal between upwardly facing shoulder area 16 of seating nipple 14 and downwardly-facing shoulder area 20 or main plug body 18 is improved by providing resilient sealing means 22 between the two shoulder areas. Preferably, groove 23 is machined in either shoulder area 16 or shoulder area 20 and an O-ring or similar resilient flexible member is placed in the groove. Likewise, it is preferred to improve the seal between bottom end 32 of relief plug member 30 and shoulder area 26. This can be done by making bottom end 32 an insert of a resilient material such as polytetrafluoroethylene or similar natural or synthetic rubbers or polymer materials or a soft metal.

WELL EXAMPLE 1

It was desired to determine the nature and extent of pressure falloff in an Illinois well having a depth of 2,530 feet. 2,500 feet of 2-inch diameter tubing was run in the well with a seating nipple forming part of the tubing string positioned at 2,470 feet. A main plug body and accompanying apparatus as shown in FIG. 2 was run into the tubing via an electrical conducting cable and positioned 10 feet above the seating nipple. An electrical surface-recording gauge manufactured by Geophysical Research was used. Water was then injected into the well at the rate of 96 barrels per day for 23 hours. After this time, the valve at the surface through which the water has been injected was closed. Simultaneously, the main plug body and accompanying apparatus was lowered into contact with the seating nipple and tension on the electrical conducting cable was relaxed so that the relief plug closed against its seal. Surface pressure readings indicated that afterflow, i.e., continued flow of fluid out of the bottom of the tubing, lasted less than 15 minutes following shut-in. This was pointed up by a rapid decrease in pressure followed by a leveling off of pressure following shut-in. Previous runs with similar conditions in which no subsurface tubing shut-off valve was used showed an afterflow of 4 hours or more following shut-in. Such afterflow is quite detrimental to the results of pressure transient tests. Following completion of the test, tension was applied to the electrical conducting cable to pull the relief plug away from its seal. The entire apparatus was then pulled free of the seating nipple and out of the well.

WELL EXAMPLE 2

It is desired to determine the areal average permeability, porosity, and hydraulic diffusivity between an injection source well and a shut-in observation well. With complete bottom-hole shut-in at the observation well obtained using the apparatus described in FIG. 1, the correct values of permeability, porosity, and diffusivity are obtained from this interference test between the two wells. With shut-in only at the surface, afterflow occurs at the observation well when the interference response arrives. The pressure response recorded at the observation well is then not the true pressure response. As a result, the values of permeability, porosity, and diffusivity determined from this afterflow-affected test are in error. Depending on the conditions of permeability, wellbore condition of the observation well, and other factors, the errors can be extreme: higher than 40 percent for permeability, higher than 99 percent for porosity, and higher than 46 percent for hydraulic diffusivity.

We claim:

1. Apparatus for seating in a seating nipple in a well tubing string for use in temporarily shutting off fluid flow through the tubing at a subsurface location in a well and making pressure determinations below the plug comprising:

a. a main plug body having a passageway therethrough, said passageway providing fluid communication from the tubing below the seating nipple to the tubing above the seating nipple, said main plug body having a downwardly-facing shoulder area around the exterior thereof adapted to seat against an upwardly-facing shoulder area of a seating nipple and form a fluid impermeable seal therewith;

b. relief plug means carried by said main plug body and biased to close said passageway therein;

c. a relief plug port extending through the relief plug means to provide fluid communication between the passageway and the upper portion of the relief plug means;

d. connecting means attached to said relief plug means for connecting said apparatus to cable means for lowering and raising said apparatus through the well tubing string;

e. said relief plug means being adapted to close said passageway when the apparatus is seated in a seating nipple and no upward force is imposed on said connecting means, and to open said passageway when an upward force is applied to said connecting means, and f. means forming a part of said apparatus for attaching a pressure indicating means to said apparatus.

2. The apparatus of claim 1 wherein pressure indicating means comprising a subsurface recording pressure gauge is attached thereto.

3. The apparatus of claim 1 wherein the downwardly-facing shoulder area of said main plug body has a groove therein and a sealing means is positioned in said groove.

4. The apparatus of claim 1 wherein the passageway through the main plug body comprises a first main plug body port extending from an opening below the downwardly-facing shoulder of the main body plug to an upwardly-facing relief plug seating area against which the relief plug means seats, and a second main plug body port extending from the relief plug seating area to an opening above the downwardly-facing shoulder of the main plug body.

5. The apparatus of claim 1 including spring means urging the relief plug means toward a closed position.

6. The apparatus of claim 1 including a surface recording gauge attached thereto.

7. The apparatus of claim 1 including fluid passage means extending from the relief plug means, said fluid passage means comprising the interior of a hollow flexible conduit extending from the connecting means for connection to a surface located pressure indicating means.

8. The apparatus of claim 1 including a hollow housing attached to the upper end of the relief plug means in fluid communication with the relief plug port.

9. The apparatus of claim 8 including pressure indicating means contained in the hollow housing.

10. The apparatus of claim 9 wherein the pressure indicating means produces an electrical signal, and an electrical conducting cable extends from the pressure indicating means.

11. The apparatus of claim 9 including a subsurface pressure recording gauge attached to the lower end of the main body plug.

* * * * *